US007153150B2

(12) United States Patent
Atsumi et al.

(10) Patent No.: US 7,153,150 B2
(45) Date of Patent: Dec. 26, 2006

(54) WATERPROOF INTERCONNECT STRUCTURE FOR ENGAGING ELECTRICAL WIRE

(75) Inventors: Sumito Atsumi, Shizuoka (JP); Kei Sato, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/326,417

(22) Filed: Jan. 6, 2006

(65) Prior Publication Data

US 2006/0160392 A1 Jul. 20, 2006

(30) Foreign Application Priority Data

Jan. 14, 2005 (JP) ..... 2005-007466

(51) Int. Cl.
*H01R 4/64* (2006.01)
*H01R 4/60* (2006.01)

(52) U.S. Cl. ..... 439/204

(58) Field of Classification Search ..... 439/204, 439/936, 587, 210, 519
See application file for complete search history.

(56) References Cited

FOREIGN PATENT DOCUMENTS

JP 8-148219 6/1996

*Primary Examiner*—Javaid H. Nasri
(74) *Attorney, Agent, or Firm*—Armstrong, Kratz, Quintos, Hanson & Brooks, LLP

(57) ABSTRACT

The present invention is intended to provide a waterproof grommet structure which can be taken apart into its constituent pieces, i.e., a grommet, a connector, a terminal, etc., even after filled with waterproofing agent, to allow its maintenance to be performed. A waterproofing agent tank 2*c* is isolated from a hollow portion 2*b* which is consecutively arranged with a connector rib 2*a*, to form a separate compartment. The waterproofing agent tank 2*c* comprises an inlet 2*d* formed as an aperture thereon and configured to feed waterproofing agent therethrough; a first through-hole 2*e* penetrating between the inside of the tank 2*c* and the hollow portion 2*b* to form a link therebetween; and a second through-hole 2*f* penetrating between the inside of the tank 2*c* and an external environment to form a link therebetween. An electrical wire 4 is positioned in a manner that, after passing through the hollow portion 2*b*, it is positioned in a manner that, after passes through both the first through-hole 2*e* and second through-hole 2*f* while tightly adhered to the first through-hole 2*e* and second through-hole 2*f*, and then passes through the waterproofing agent tank 2*c*.

8 Claims, 7 Drawing Sheets

WATERPROOF INTERCONNECT STRUCTURE FOR ENGAGING ELECTRICAL WIRE

CROSS-REFERENCE TO RELATED APPLICATIONS

The present application claims priority under 35 U.S.C. §119 of Japanese Patent Application No. JP 2005-007466 filed on Jan. 14, 2005, the disclosure of which is expressly incorporated by reference herein in its entirety.

BACKGROUND OF THE INVENTION

1. Field of the Invention

The present invention relates to a waterproof interconnect structure for engaging an electrical wire, such as a connector and a grommet.

2. Description of the Related Art

Conventionally, a variety of waterproof interconnect structures such as a connector and a grommet have been proposed to provide a watertight seal to an electrical wire positioned on a vehicle body. Referring FIGS. 14 and 15, as such structure, shown there are grommets that are sealed against moisture contamination. FIG. 14 is a perspective view of a conventional grommet and a connector equipped with the same grommet. FIG. 15 is a cross section showing the manner of assembling the grommet of FIG. 14.

As viewed in FIGS. 14 and 15, the conventional grommet formed of a rubber material, is inserted into a terminal-receiving cavity 97 of a connector main body 91 receiving an electrical wire 95 which is connected to a terminal 96 at its end area; has a circumferential rib 93 to be fit into a rearward end of the connector main body 91 with the electrical wire 95 extending rearwardly therefrom; and further is consecutively arranged with a snake-shaped electrical wire tubular portion 94 for introducing the electrical wire 95 into an hollow portion.

Subsequently, in order to provide connection of the electrical wire 95 beyond a grommet 92 and the connector main body 91, the electrical wire 95 is passed through the hollow portion of the grommet 92, the terminal 96 corresponding to the electrical wire 95 is mounted in the terminal-receiving cavity 97 of the connector main body 91, and then the connector rib 93 is fit into the connector main body 91. Next, to provide a watertight seal to the electrical wire 95, a syringe 90 is placed on the front face of the connector main body 91 for feeding waterproofing agent, grease 99, and then grease 99 is poured into the grommet 92 via the connector main body 91. Such a grommet 92 to be positioned, for example, on the door of a vehicle, mainly prevents moisture migration along the length of the electrical wire from the right side of the electrical wire tubular portion 94 as shown in the FIG. 15.

Generally, the connector main body 91 is the assembly of a terminal, a plate, a connector, a connector housing and so on. For example, when maintenance of the connector assembly is required to be performed, the assembly should be taken apart into its constituent pieces as mentioned above. Particularly, separation between the grommet and the connector housing, between the connector housing and the connector, between the connector and the plate, and between the plate and the terminal has to be happen respectively.

However, with respect to the conventional waterproof grommet structure 92, once grease 99 has been poured thereinto, it is highly difficult to remove the grommet 92 from the connector main body 91, i.e., to disassemble the connector main body 91. That is to say, in the conventional waterproof grommet structure 92, once the grommet has been filled with grease, it is either highly difficult or otherwise impossible to perform its maintenance.

The above-discussed conventional grommet is disclosed in Japanese Laid-Open Publication No. H8-148219 (see FIG. 3).

SUMMARY OF THE INVENTION

A waterproof grommet structure is to be mounted in a connector. The grommet comprises a connecter rib configured to be fit into the connector; a hollow portion consecutively arranged with the connector rib and configured to pass an electrical-wire extending from the connector therethrough; a waterproofing agent tank consecutively arranged with the hollow portion, but isolated from the hollow portion to form a separate compartment; an inlet formed as an aperture on the waterproofing agent tank and configured to feed waterproofing agent therethrough; a first through-hole formed as an aperture on the waterproofing agent tank and configured to penetrate between the inside of the waterproofing agent tank and the hollow portion to form a link therebetween; and a second through-hole formed as an aperture on the waterproofing agent tank and configured to penetrate between the inside of the tank and an external environment to form a link therebetween. The electrical wire is positioned in a manner that, after passing through the hollow portion, it passes through the first through-hole and second through-hole while tightly adhered to the first through-hole and second through-hole, and then passes through the waterproofing agent tank.

According to the invention, the waterproofing agent tank is isolated from the hollow portion which is consecutively arranged with the connector rib, to form a separate compartment. There is also provided the waterproofing agent tank equipped with the inlet for feeding waterproofing agent therethrough, the first through-hole for penetrating between the inside of waterproofing agent tank and the hollow portion to form a link therebetween, and the second through-hole penetrating between the inside of waterproofing agent tank and an external environment to form a link therebetween. Moreover, the electrical wire is positioned in a manner that, after passing through the hollow portion, it passes through the first through-hole and second through-hole while tightly adhered to the first through-hole and second through-hole, and then passes through the waterproofing agent tank. In this case, since the waterproofing agent tank which the electrical wire passes through is formed as a separate compartment as mentioned above, even after the waterproofing agent tank has been filled with waterproofing agent, it is allowed to remove the grommet, the connector, the terminal, etc. from the grommet-connector assembly, without any deterioration in waterproofness.

According to the invention, the waterproof grommet structure is further characterized in that the waterproofing agent tank has volume which is selected to be less than volume of the hollow portion, allowing an amount of waterproofing agent needed to provide watertight seal to be cut down.

According to the invention, the waterproof grommet structure is further characterized in that the waterproofing agent tank is formed near to the end area opposite to the connector rib. That is to say, the waterproofing agent tank is located distantly from the connector rib.

According to the invention, the waterproof grommet structure is further characterized in that the connector comprises the assembly of a plate configured to maintain a terminal to be connected to the end of the electrical wire; a subconnector configured to house the plate therewithin; and a connector housing configured to house the subconnector therewithin and to be fit into the connector rib.

According to the invention, although the connector comprises the assembly of the plate, the subconnector and the connector housing, since the waterproofing agent tank is formed as a separate compartment as discussed above, even after the waterproofing agent tank has been filled with waterproofing agent, the connector assembly can be taken apart into its constituent pieces, i.e., the plate, the subconnector, the connector housing, etc., respectively. Accordingly, maintenance of the connector assembly can be performed without any deterioration in waterproofness.

DETAILED DESCRIPTION OF THE INVENTION

To solve above-mentioned problems, the present invention provides the waterproof grommet structure which can be taken apart into its constituent pieces (i.e., the grommet, the connector, the terminal, etc.) even after being filled with waterproofing agent, allowing its maintenance to be performed.

According to the invention, the waterproofing agent tank is isolated from the hollow portion consecutively arranged with the connector rib, to form a separate compartment. There is also provided the waterproofing agent tank equipped with the inlet for feeding waterproofing agent therethrough, the first through-hole for penetrating between the inside of waterproofing agent tank and the hollow portion to form a link therebetween, and the second through-hole penetrating between the inside of waterproofing agent tank and an external environment to form a link therebetween. Moreover, the electrical wire is positioned in a manner that, after passing through the hollow portion, it passes through the first through-hole and second through-hole while tightly adhered to the first through-hole and second through-hole, and then passes through the waterproofing agent tank. In this case, since the waterproofing agent tank through which the electrical wire passes is formed as a separate compartment, even after the tank has been filled with waterproofing agent, it is allowed to remove the grommet, the connector, the terminal, etc. from the grommet-connector assembly, without any deterioration in waterproofness. Therefore, maintenance on each parts of the assembly can be carried out even after the waterproofing agent tank has been filled with waterproofing agent.

According to the invention, the waterproofing agent tank has volume which is selected to be less than volume of the hollow portion, allowing an amount of waterproofing agent needed to provide watertight seal to be cut down while achieving afore-mentioned advantages.

According to the invention, the waterproofing agent tank is formed near to the end area opposite to the connector rib. That is to say, the waterproofing agent tank is located distantly from the connector rib. Thus, maintenance on each parts of the assembly can be safely carried out without any deterioration in waterproofness.

According to the invention, although the connector comprises the assembly of the plate, the subconnector and the connector housing, since the waterproofing agent tank is formed as a separate compartment, even after the waterproofing agent tank has been filled with waterproofing agent, the connector assembly can be taken apart into its constituent pieces respectively. Accordingly, maintenance of the connector assembly can be performed without any deterioration in waterproofness.

Figure 1:
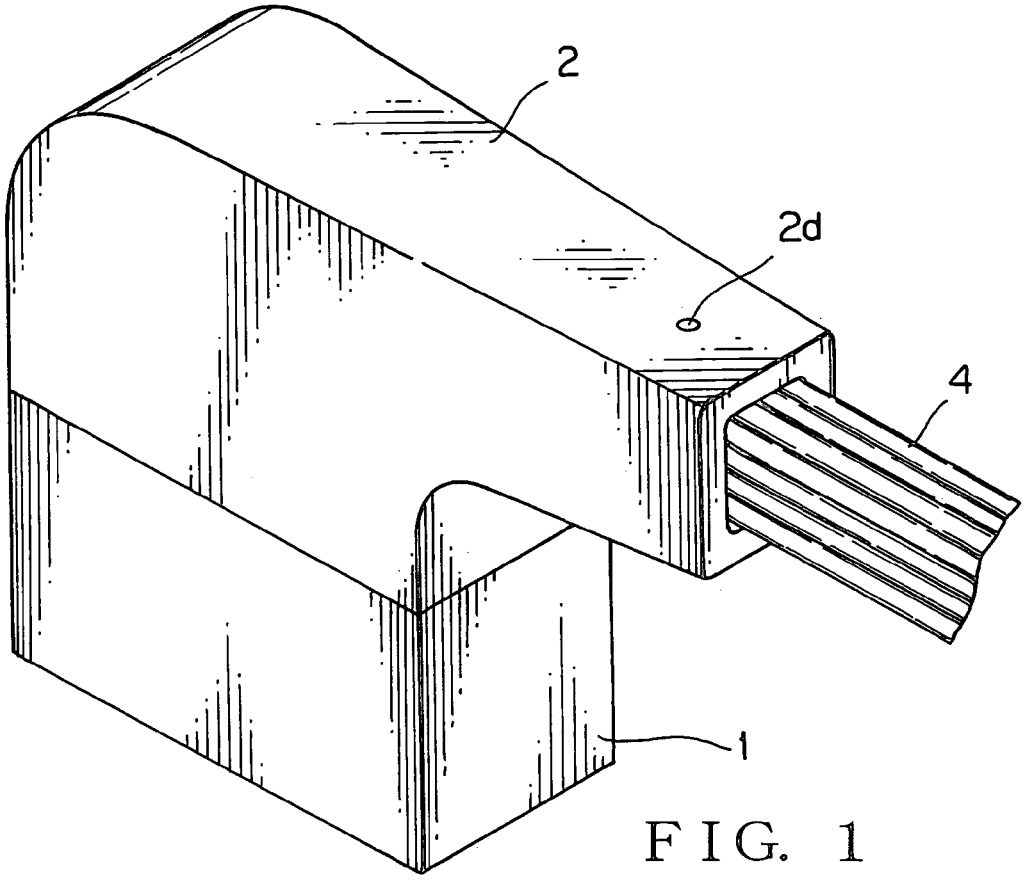
FIG. 1 is a perspective view of an embodiment of the waterproof grommet structure in accordance with the present invention.
Figure 2:
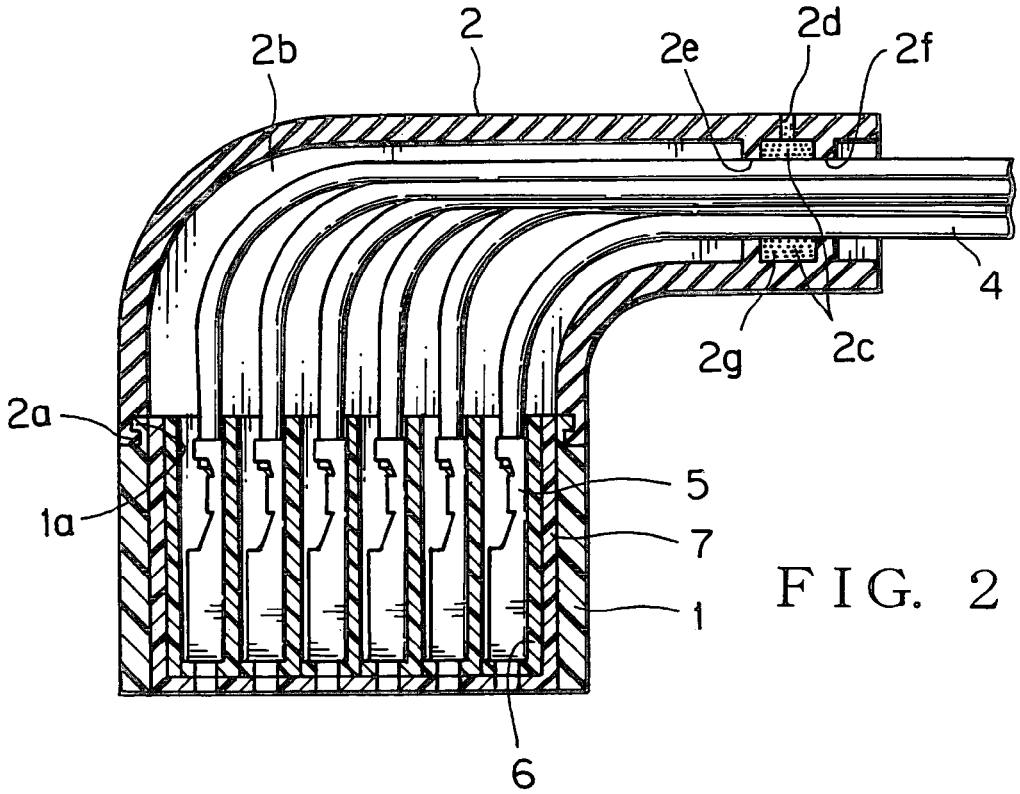
FIG. 2 is a cross sectional view of the grommet as depicted in FIG. 1.
Figure 3:
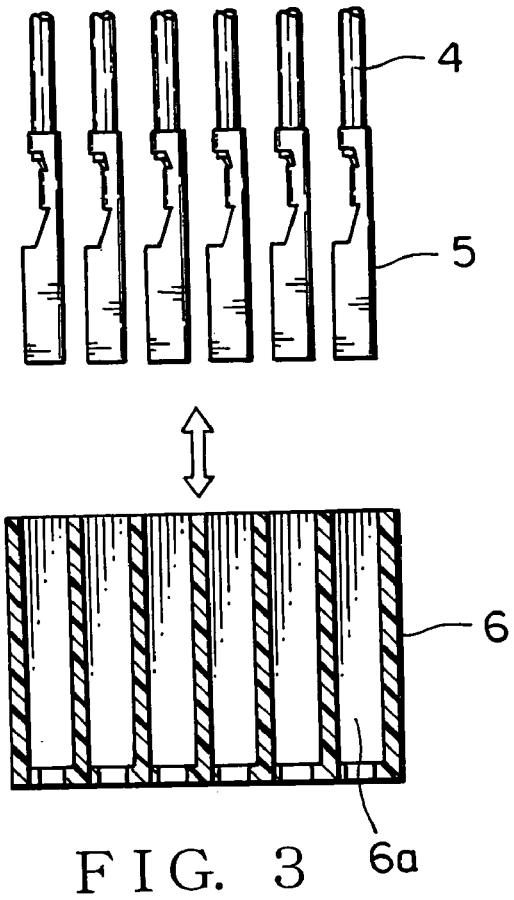
FIG. 3 is a cross sectional view for illustrating how to couple a terminal and a plate together as well as how to disassemble the terminal-plate assembly.
Figure 4:
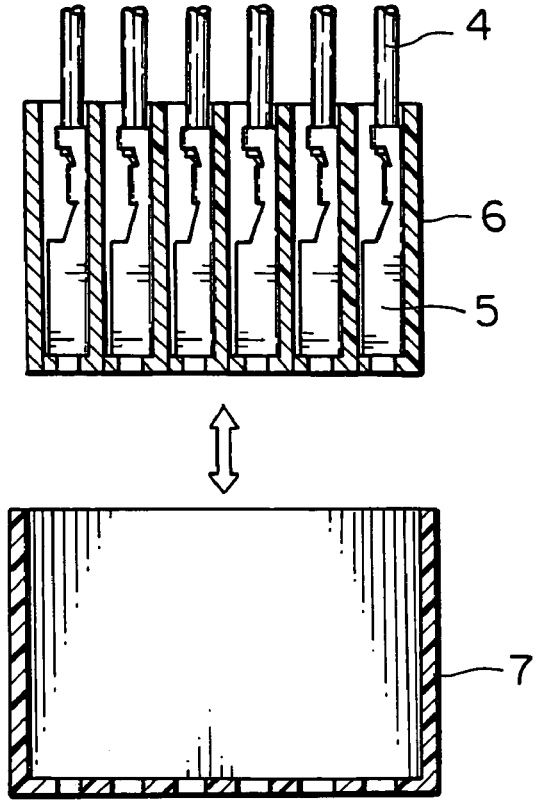
FIG. 4 is a cross sectional view for illustrating how to couple a subconnector and a plate together as well as how to disassemble the subconnector-plate assembly.

The invention will now be described by way of example with reference to the accompanying figures wherein identical elements are referred to by common character numbers. Reference is now made to FIGS. 1–4 of the drawings in detail, which illustrate an embodiment of the waterproof grommet structure in accordance with the present invention. FIG. 1 shows a perspective view of an embodiment of the waterproof grommet structure in accordance with the present invention. FIG. 2 shows a cross sectional view of the grommet as depicted in FIG. 1. FIG. 3 shows a cross sectional view for illustrating how to couple a terminal and a plate together as well as how to disassemble the terminal-plate assembly. FIG. 4 shows a cross sectional view for illustrating how to couple a subconnector and a plate together as well as how to disassemble the subconnector-plate assembly.

Referring to FIGS. 1 and 2, a grommet 2 is, for example, tube-shaped and formed of a rubber material. The grommet 2 comprises a connector rib 2*a* configured to be fit into a rib 1*a* of connector housing 1; a hollow portion 2*b* consecutively arranged with the connector rib 2*a* and also configured to pass an electrical wire 4 extending from a connector 7 therethrough; a waterproofing agent tank 2*c* consecutively arranged with the hollow portion 2*b* but isolated from the hollow portion 2*b* as a separate compartment. The connector rib 2*a* is formed along an aperture plane of the grommet 2, and is to be fit into the corresponding housing rib 1*a*. In the grommet 2, the hollow portion 2*b* has a diameter that is gradually getting smaller from the aperture plane to the waterproofing agent tank 2*c* while being therebetween. Therefore, the grommet 2 has a maximum diameter at the connector rib 2*a*, and while bending toward the waterproofing agent tank 2*c* it has a gradually decreasing diameter.

The waterproofing agent tank 2*c* has an inlet 2*d* for feeding waterproofing agent therethrough; a first through-hole 2*e* penetrating between the inside of the waterproofing agent tank 2*c* and the hollow portion 2*b* to form a link therebetween; and a second through-hole 2*f* penetrating between the inside of the waterproofing agent tank 2*c* and an external environment to form a link therebetween. The inlet 2*d* is formed as a hole which corresponds to the syringe needle for feeding grease (not shown). The first through-hole 2*e* and second through-hole 2*f* exist in a straight line, while each having the same sized round shape. Each of the first through-hole 2*e* and second through-hole 2*f* has its diameter that is proportional to the thickness of a bundle of electrical wires 4. More specifically, since the grommet 2 is formed of a rubber material with resilience, the diameter of each of holes 2*e*, 2*f* is preferably slightly smaller than the thickness of a bundle of electrical wires 4. Once a plurality of electrical wires 4 have passed through both the first through-hole 2*e* and second through-hole 2*f*, they are to be fastened tight at said holes 2*e*, 2*f*.

A bundle of electrical wires 4 extending from the connector, after passing through the hollow portion 2*b*, pass through both the first through-hole 2*e* and second through-hole 2*f* while tightly adhered to the first through-holes 2*e* and second through-hole 2*f*, and then pass through the waterproofing agent tank 2*c*.

Meanwhile, referring to FIG. 2, a connector comprises the assembly of a connector housing 1, a plate 6 and a subconnector 7. More specifically, as shown in FIGS. 3 and 4, the plate 6 is formed with a plurality of receptacle parts 6*a*, which are formed as separate compartments each other in parallel, corresponding to terminals 5 connected to each end of electrical wires 4 respectively in a manner that they receive corresponding terminals 5 respectively. In this case, the plate 6 also has a hole for insertion of a male terminal thereinto. Refer to reference numeral 43 in FIG. 13. Further, there is provided a stack of plates 6 each of which is box-shaped (corresponding to 43*a* in FIG. 12). The subconnector 7 (corresponding to 42*a* in FIG. 12) is also molded in the form of a box in order to house the same plate 6 therewithin. Next, the subconnector 7 is housed within the box-shaped connector housing 1 (corresponding to 41 in FIG. 12). Further, the connector housing 1 is provided with the rib 1*a* configured to be fit into the connector rib 2*a* of the grommet 2.

The connector assembly as mentioned previously, for the purpose of performing its maintenance, should be taken apart into its constituent pieces. For example, it is required to separate between grommet 2 and the connector housing 1, and between the connector housing 1 and the subconnector 7, respectively, and further, as indicated by arrows in FIGS. 3 and 4, between the subconnector 7 and the plate 6, and between the plate 6 and the terminal 5, respectively. The grommet 2 in accordance with the present invention would make it possible to carry out its maintenance easily, which will be made clear from the following description.

As depicted in FIG. 2, the electrical wire 4 is positioned in a manner that after passing through the hollow portion 2*b*, it passes through both the first through-hole 2*e* and second through-hole 2*f* while tightly adhered to the first through-hole 2*e* and second through-hole 2*f*, and then passes through the waterproofing agent tank 2*c*. The connector rib 2*a* of the grommet 2 is fit into the rib 1*a* of the connector housing 1. Thereafter, the syringe needle for grease feeding is put into the inlet 2*d* of the waterproofing agent tank 2*c* such that waterproofing agent, grease 2*g* is poured into the waterproofing agent tank 2*c*. Alternatively, the grommet 2 may be fit into the connector housing 1 after completion of grease 2*g* feeding.

For the purpose of performing maintenance operation, in the case of the assembly as shown in FIG. 2, it is required to separate between the grommet 2 and the connector housing 1, and between the connector housing 1 and the subconnector 7, respectively. Moreover, as shown by arrows in FIGS. 3 and 4, it is also required to separate between the subconnector 7 and the plate 6, and between the plate 6 and the terminal 5, respectively. In this case, as depicted in FIG. 2, since the waterproofing agent tank 2*c* which the electrical wire 4 passes through is formed as a separate compartment, even after the waterproofing agent tank 2*c* has been filled with grease 2*g*, each part such as the grommet, the connector, the terminal, etc. can be easily removed from the assembly without any deterioration in waterproofness. Therefore, maintenance on each part of the assembly can be safely carried out even after the waterproofing agent tank 2*c* has been filled with grease 2*g*.

In addition, as shown in FIG. 2, the waterproofing agent tank 2*c* has volume which is selected to be less than volume of the hollow portion 2*b*, allowing an amount of waterproofing agent needed to provide watertight seal to be cut down while achieving afore-mentioned advantages. Further, the waterproofing agent tank 2*c* is formed near to the end area opposite to the connector rib 2*a*. That is to say, the waterproofing agent tank 2*c* is located distantly from the connector rib 2*a* where maintenance operation is to be carried out. Thus, maintenance on each parts of the assembly can be safely carried out, without any deterioration in waterproofness.

Figure 8A:
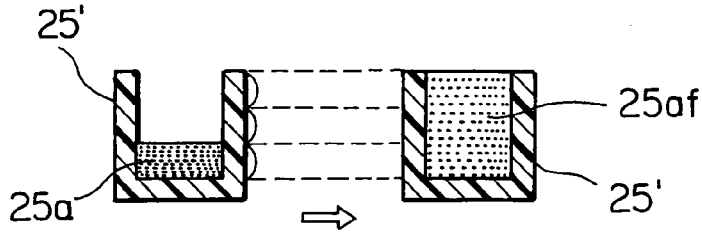
FIG. 8A is a view for describing the principle of the first embodiment of waterproof connector structure in accordance with the present invention.
Figure 8B:
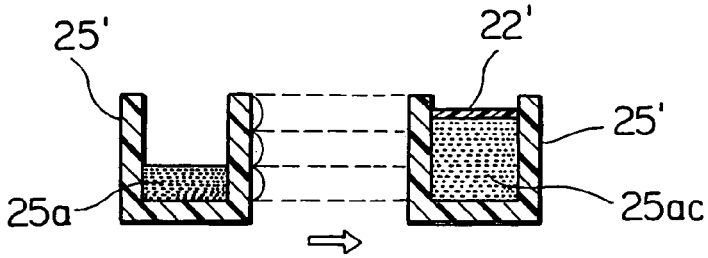
FIG. 8B is a view for describing the principle of the first embodiment of the waterproof connector structure in accordance with the present invention.
Figure 9:
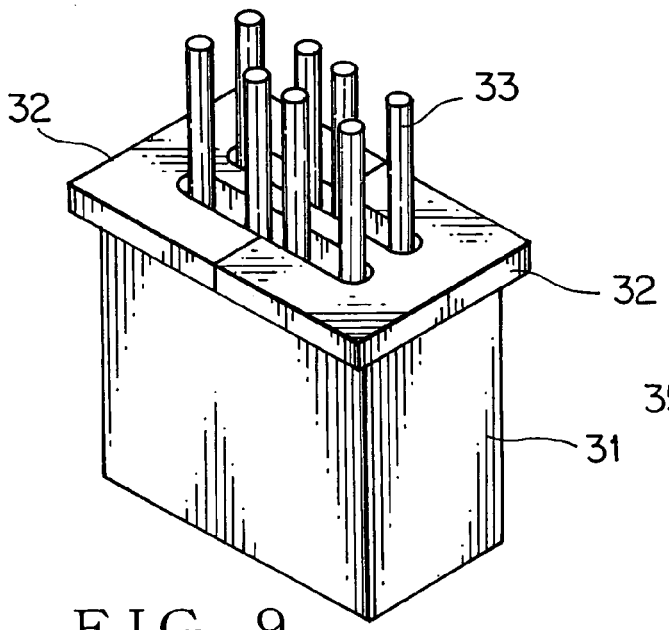
FIG. 9 is a perspective view of a second embodiment of the waterproof connector structure in accordance with the present invention.
Figure 10:
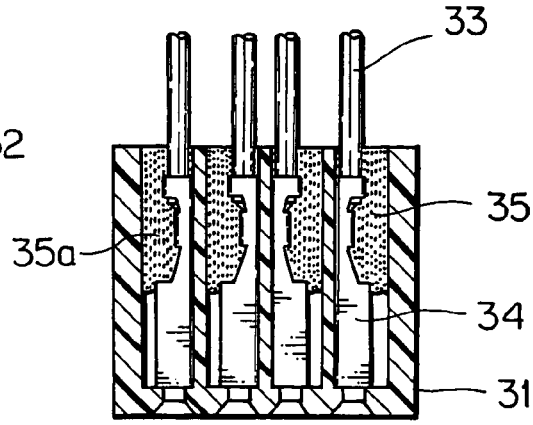
FIG. 10 is a cross sectional view of the connector as depicted in FIG. 9.
Figure 11:
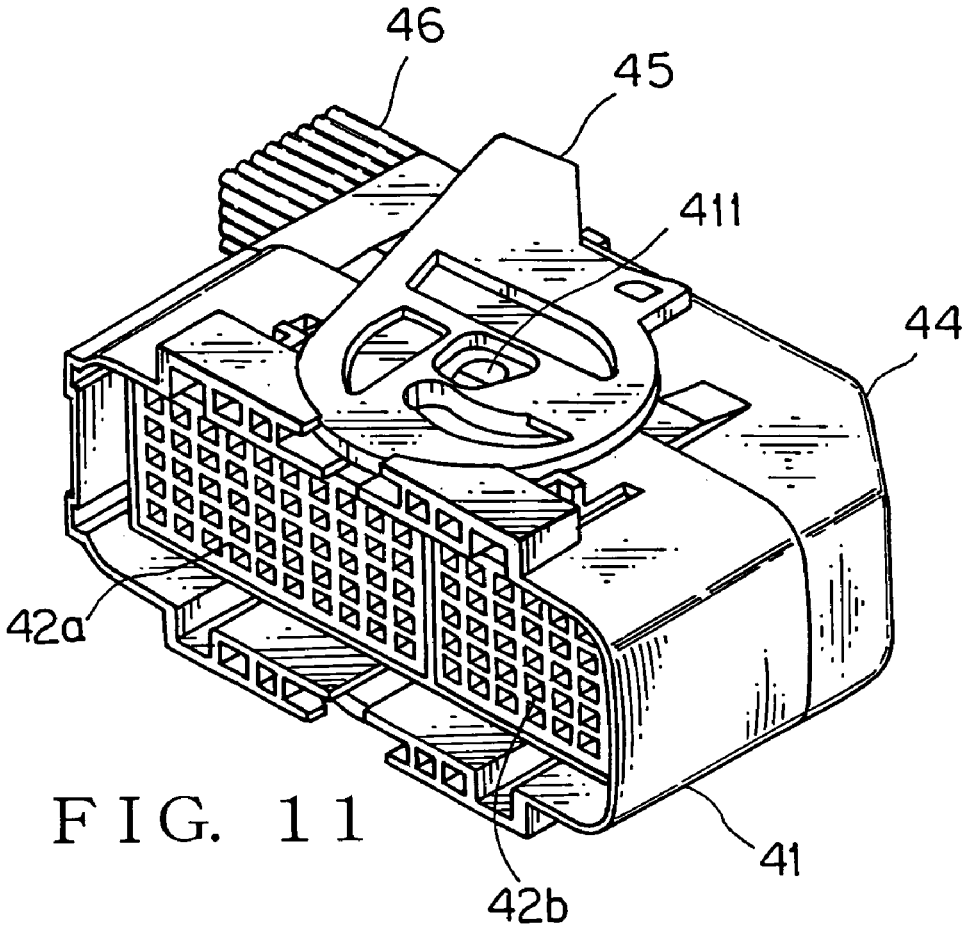
FIG. 11 is a perspective view of a third embodiment of the waterproof connector structure in accordance with the present invention.
Figure 14:
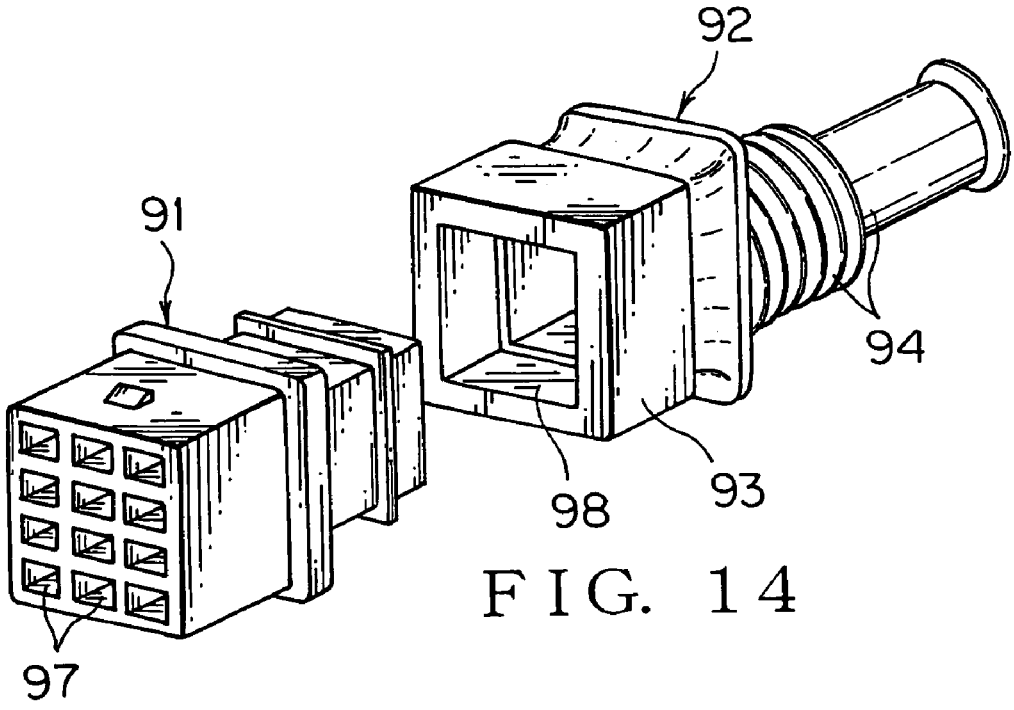
FIG. 14 is a perspective view of a conventional grommet and a connector equipped with the same grommet.
Figure 12:
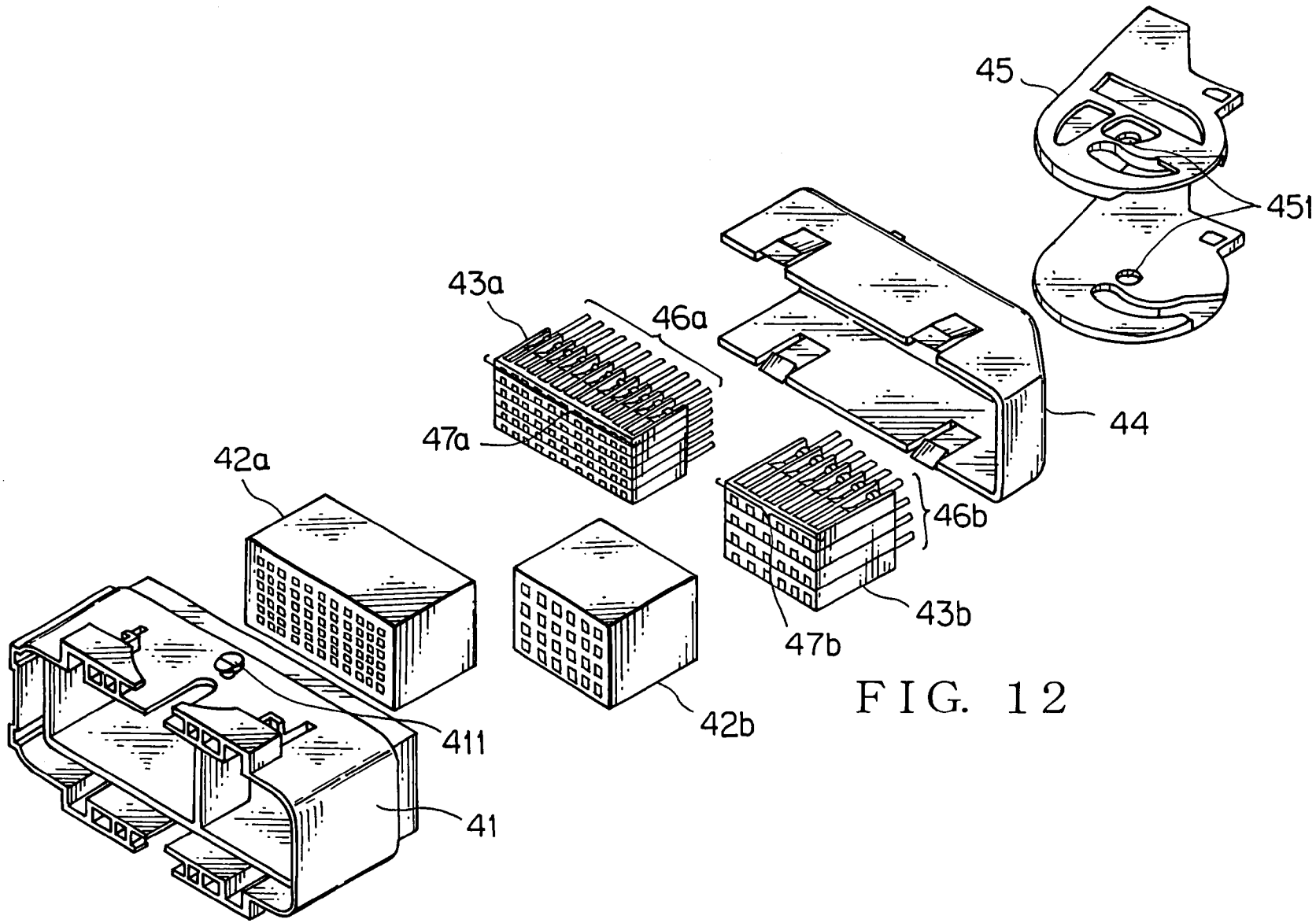
FIG. 12 is a cross sectional view of the connector as depicted in FIG. 11.
Figure 13:
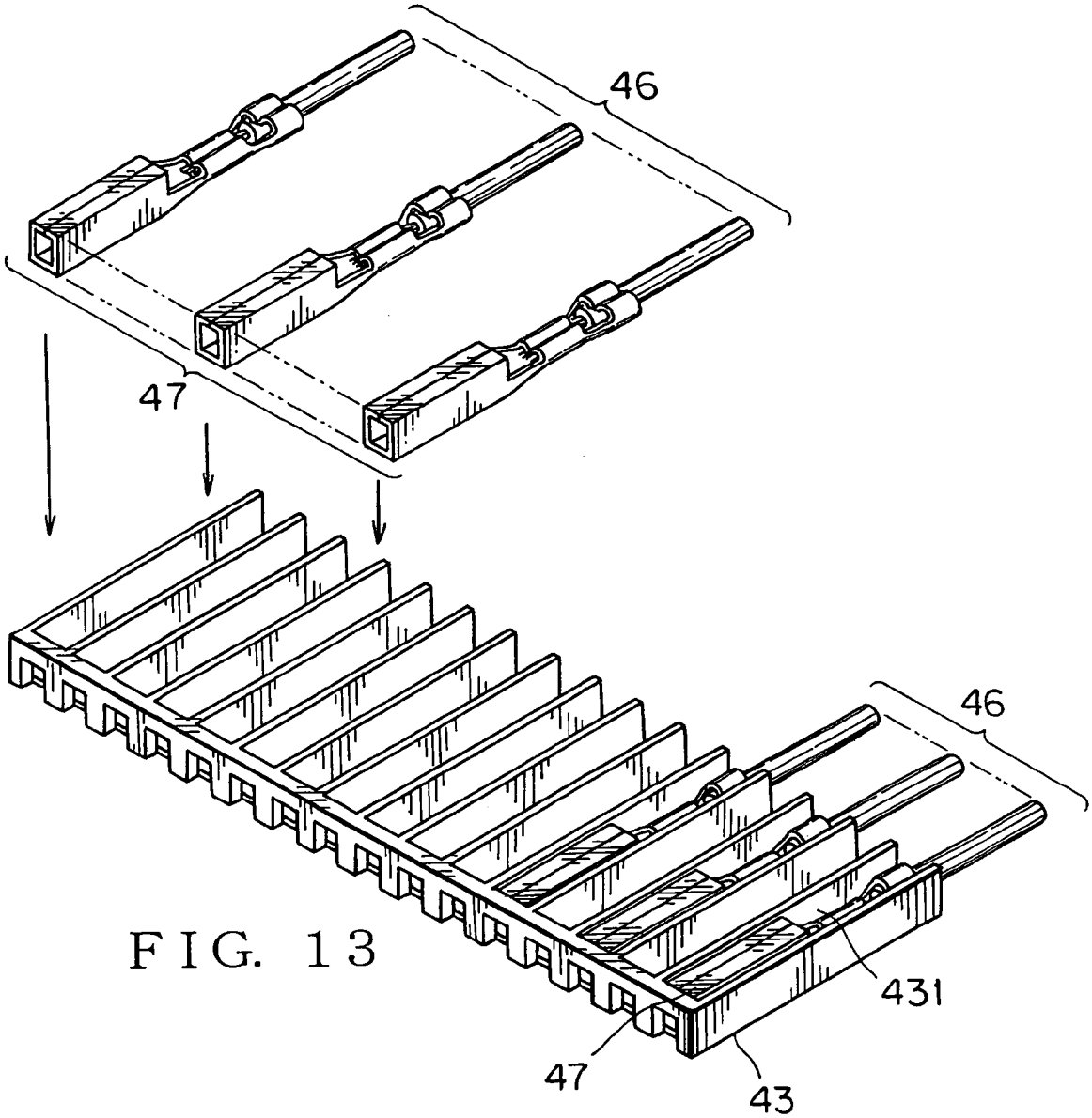
FIG. 13 is an exploded perspective view of the plate as depicted in FIG. 12.
Figure 15:
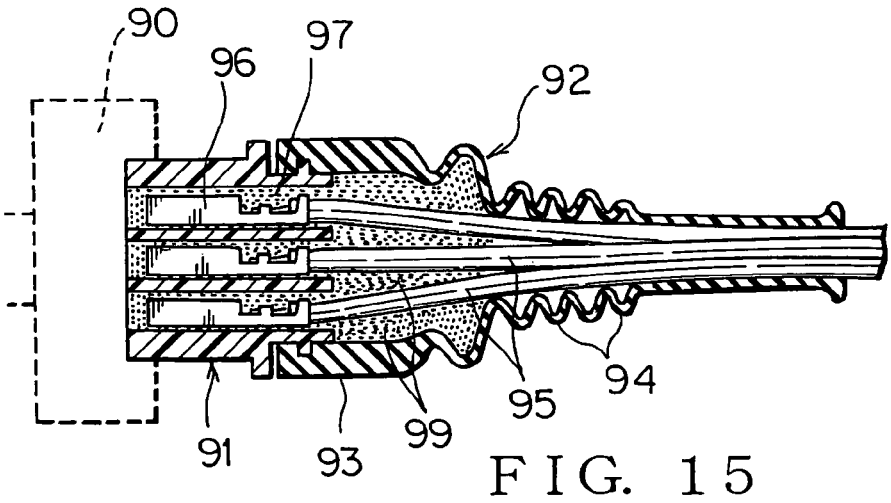
FIG. 15 is a cross sectional view for illustrating the state that the grommet as depicted in FIG. 14 has been mounted in the connector.

Referring to FIGS. 5–13, shown there are several embodiments of the waterproof connector structure in accordance with the present invention. FIGS. 5–8 show a first embodiment of the waterproof connector structure in accordance with the present invention, FIGS. 9 and 10 show a second embodiment of the waterproof connector structure in accordance with the present invention, and FIGS. 11–13 show a third embodiment of the waterproof connector structure in accordance with the present invention, respectively.

Figure 5:
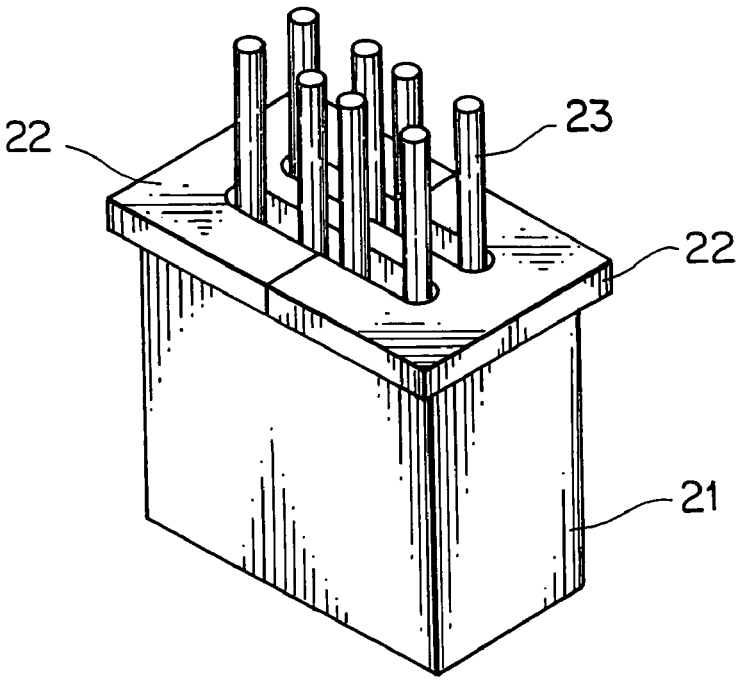
FIG. 5 is a perspective view of a first embodiment of the waterproof connector structure in accordance with the present invention.
Figure 7:
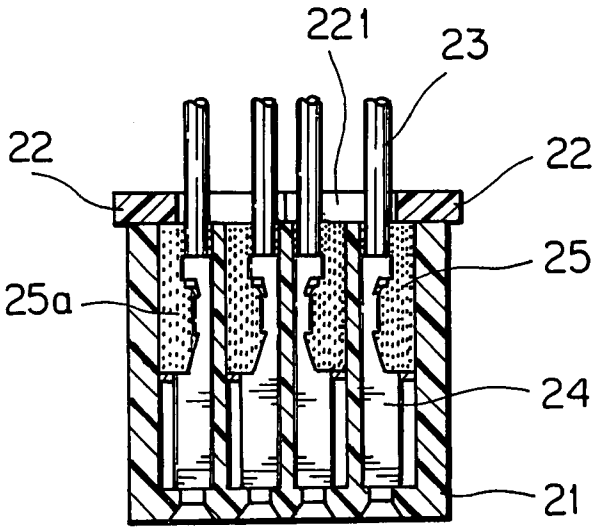
FIG. 7 is a cross sectional view of the connector as depicted in FIG. 5
Figure 6:
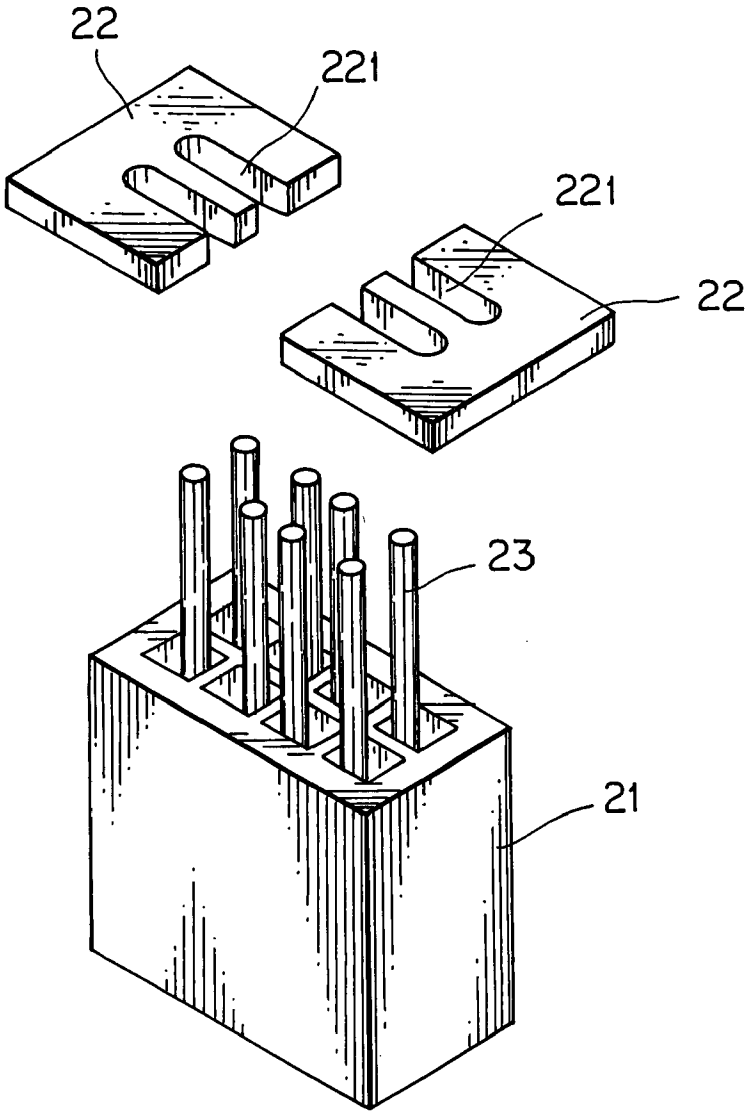
FIG. 6 is an exploded perspective view of the connector as depicted in FIG. 5.

The first embodiment of the connector according to the present invention, as shown in FIG. 5, comprises the assembly of a connector 21 to which an electrical wire 23 is attached, a jig 22 and blowing agent 25*a* such as urethane as waterproofing agent (see FIG. 7). The jig 22, as shown in FIG. 6, is divided into two sections, each of which is formed with slotted areas 221 against the electrical wire 23 extending from the connector 21. After completion of blowing agent 25*a* infusion, as shown in FIG. 7, two sections of jig 22 are combined in a manner that the electrical wires 23 are surrounded by the slotted areas 221 thereof, and are mounted on top of the connector 21.

Referring to FIGS. 8A and 8B, the principle of the first embodiment as noted above will be described. As shown in FIG. 8A, once blowing agent 25*a* inside a feed tank 25' has been subjected to free blowing, it has a volume that is three times larger than that of original material 25*a* (At this state, blowing agent is designated by 25*af*). Accordingly, as shown in FIG. 8B, blowing agent 25*a* should be blown out under a condition that the feed tank 25' is capped with a jig 22', so that it is blown out with compressed air until it has a volume that is from 2 to 2.5 times larger than that of original material 25*a* (At this state, blowing agent is designated by 25*ac*). In this case, blowing agent 25*a*, after completion of such blowing operation, will exhibit improved density and excellent blowing capability, and therefore, it can tightly seal the gap between electrical wires, which has never been attained by the conventional free-blowing method.

By using the above-mentioned principle, with respect to FIG. 7, blowing agent 25*a* which has been blown out inside the feed tank 25 under the presence of the jig 22 can tightly seal the gap between the electrical wires 23 to meet its sealing requirement as well as decrease an amount of blowing agent 25*a* needed to provide watertight seal. Further, the jig 22, after completion of such blowing operation, can be removed from the assembly as shown in FIG. 7 and also recycled.

Thereafter, the second embodiment of the connector according to the present invention, as shown in FIG. 9 comprises the assembly of a connector 31 to which an electrical wire 23 is attached, a jig 32 and blowing agent 35*a* such as urethane as waterproofing agent (see FIG. 10). The jig 32 has the same constitution as the jig 22 shown in FIG. 6. Referring to FIG. 10, after completion of blowing agent 35*a* infusion, two sections of the jig 32 are combined in a manner that the electrical wires 33 are surrounded by slotted areas thereof, and are mounted on top of the connector 31.

The principle of the second embodiment as noted above is characterized by selection of blowing agent 35*a*. That is to say, referring to FIG. 10, clay and blowing agent 35*a* would be selected for the purpose of preventing blowing agent 35*a* from penetrating into the contact area of a terminal 34 (the lower part of the electrical wire 33 and the terminal 34 in FIG. 10).

By using the above-mentioned principle, with respect to FIG. 10, blowing agent 35*a* which has been blown out inside a feed tank 36 under the presence of the jig 32 can tightly seal the gap between the electrical wires 33 to meet its sealing requirement. As mentioned above, the selection of blowing agent makes possible achieving excellent sealing properties, resulting in simplification of structure of the connector 31 as well as improvement in its working efficiency. The jig 32, after completion of such blowing operation, can be removed from the assembly as shown in FIG. 10 and also recycled.

Further, the third embodiment of the connector according to the present invention, as shown in FIGS. 11 and 12, comprises the assembly of subconnectors 42*a* and 42*b* to which an electrical wire 46 is attached; a connector housing 41 for housing both subconnectors 42*a* and 42*b* therewithin; a side cover to be fit into the connector housing 41; and a lever 45 rotating along a rotation axis 411 of the connector housing 41. In this connector, a guide pin which is formed in a counter-connector (not shown) is fit into a guide groove of the lever 45. As a result, the guide pin is pulled up in combination with the rotation of the lever, and then the connector housing 41 and the counter-connector are fit together.

Blowing agent such as urethane is flown into a side cover 44, and then, efficiently seal either the gap between electrical wires inside the connector 41, or other gap needing for such watertight seal.

In addition, with respect to the third embodiment as noted above, there are also provided several designs for enhancing its working efficiency. That is to say, referring to FIG. 13, a terminal 47 to which an electrical wire 46 is connected, when assembled, is put on a plate 43 in a direction depicted by arrows. The plate 43 is formed with a plurality of separate receptacle parts 431 corresponding to respective terminals 47. Thereafter, as shown in FIG. 12, there is provided a stack of plates as designated by 43*a* and 43*b*, each of which is fit into the subconnectors 42*a* and 42*b*, respectively. Moreover, at this state, it is allowed to carry out both false electric wiring detection and terminal position assurance inspection at the same time. When terminal types and/or the number of poles have been changed, in order to deal with the same changes, one is allowed to change the size and/or the number of plates or subconnectors.

After false electric wiring detection and/or terminal position assurance inspection have been completed, the subconnectors 42*a* and 42*b* are fit into the connector housing 41. Thereafter, electrical wires 46*a* and 46*b* are bundled together, and the side cover 44 and the lever 45 are fit into the housing 41 in sequence. As a result, the assembly as shown in FIG. 11 is formed, and then blowing agent is flown thereinto. According to the third embodiment as noted above, such a reliable waterproof structure allows both false electric wiring detection and terminal position assurance inspection to be performed at the same time even under a condition that the terminal and the electrical wire have been inserted into the subconnector. Moreover, due to the subconnector, the terminal can be inserted into said subconnector while having a relatively small number of cavities. Therefore, false terminal positioning can be prevented, and work efficiency can also be improved.

As mentioned above, according to the present invention, both the connector structure and grommet structure having excellent waterproofness can be obtained. Particularly, with respect to the first embodiment of the waterproof grommet structure, the grommet can be taken apart into its constituent pieces (i.e., a grommet, a connector, a terminal, etc.) even after filled with waterproofing agent, to allow its maintenance to be performed easily.

While a preferred embodiment of the invention has been shown and described with particularity, it will be appreciated that various changes and modifications may suggest themselves to one having ordinary skill in the art upon being apprised of the present invention. For example, the shape, structure, etc. of the grommet in accordance with the present invention may be adjusted as required by alternative embodiment. It is intended to encompass all such changes and modifications as fall within the scope and spirit of the appended claims.

The invention claimed is:

1. A waterproof grommet structure to be mounted in a connector, comprising:

a connecter rib configured to be fit into the connector;

a hollow portion consecutively arranged with the connector rib and configured to pass an electrical wire extending from the connector therethrough;

a waterproofing agent tank consecutively arranged with the hollow portion, but isolated from the hollow portion to form a separate compartment;

an inlet formed as an aperture on the waterproofing agent tank and configured to feed waterproofing agent therethrough;

a first through-hole formed as an aperture on the waterproofing agent tank and configured to penetrate between the inside of the waterproofing agent tank and the hollow portion to form a link therebetween; and a second through-hole formed as an aperture on the waterproofing agent tank and configured to penetrate between the inside of the tank and an external environment to form a link therebetween, wherein the electrical wire is positioned in a manner that, after passing through the hollow portion, it passes through the first through-hole and second through-hole while tightly adhered to the first through-hole and second through-hole, and then passes through the waterproofing agent tank.

2. The waterproof grommet structure according to claim 1, wherein the waterproofing agent tank has volume which is selected to be less than volume of the hollow portion.

3. The waterproof grommet structure according to claim 1, wherein the waterproofing agent tank is formed near to the end area opposite to the connector rib.

4. The waterproof grommet structure according to claim 2, wherein the waterproofing agent tank is formed near to the end area opposite to the connector rib.

5. The waterproof grommet structure according to claim 1, wherein the connector comprises the assembly of a plate configured to maintain a terminal to be connected to the end of the electrical wire; a subconnector configured to house the plate therewithin; and a connector housing configured to house the subconnector therewithin and to be fit into the connector rib.

6. The waterproof grommet structure according to claim 2, wherein the connector comprises the assembly of a plate configured to maintain a terminal to be connected to the end of the electrical wire; a subconnector configured to house the plate therewithin; and a connector housing configured to house the subconnector therewithin and to be fit into the connector rib.

7. The waterproof grommet structure according to claim 3, wherein the connector comprises the assembly of a plate configured to maintain a terminal to be connected to the end of the electrical wire; a subconnector configured to house the plate therewithin; and a connector housing configured to house the subconnector therewithin and to be fit into the connector rib.

8. The waterproof grommet structure according to claim 4, wherein the connector comprises the assembly of a plate configured to maintain a terminal to be connected to the end of the electrical wire; a subconnector configured to house the plate therewithin; and a connector housing configured to house the subconnector therewithin and to be fit into the connector rib.

* * * * *